United States Patent [19]

Oonishi et al.

[11] 4,340,404

[45] Jul. 20, 1982

[54] REFRIGERATING APPARATUS

[75] Inventors: Toshiyuki Oonishi, Takatsukishi; Masato Tsutsumi, Osakafu; Noboru Nakagawa, Osakashi, all of Japan

[73] Assignee: Tokyo Shibaura Denki Kabushiki Kaisha, Kawasaki, Japan

[21] Appl. No.: 190,051

[22] Filed: Sep. 23, 1980

[30] Foreign Application Priority Data

Oct. 1, 1979 [JP] Japan ..... 54-126565
Oct. 1, 1979 [JP] Japan ..... 54-126566

[51] Int. Cl.[3] ..... F25B 41/00; F25B 39/02
[52] U.S. Cl. ..... 62/198; 62/525
[58] Field of Search ..... 62/198, 525, 526; 417/208

[56] References Cited

U.S. PATENT DOCUMENTS 2,697,331 12/1954 Zearfos, Jr. ..... 62/198
2,791,101 5/1957 Zearfoss, Jr. ..... 62/198

*Primary Examiner*—William E. Wayner
*Attorney, Agent, or Firm*—Cushman, Darby & Cushman

[57] ABSTRACT

A system for feeding refrigerant in a refrigerator having a first evaporator delivering refrigerant to a second evaporator, refrigerant storage device having a first outlet to the first evaporator and a second outlet connected to the second evaporator and connected to the storage interior for equalizing developed gaseous pressures and including a generally u-shaped tube and a vapor pump for supplying refrigerant to the second evaporator and stopping the refrigerant flow to the first evaporator.

11 Claims, 12 Drawing Figures

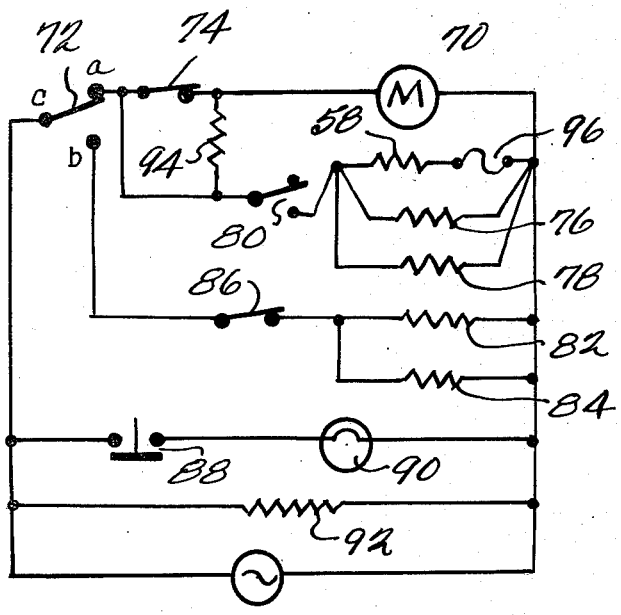
FIG 5
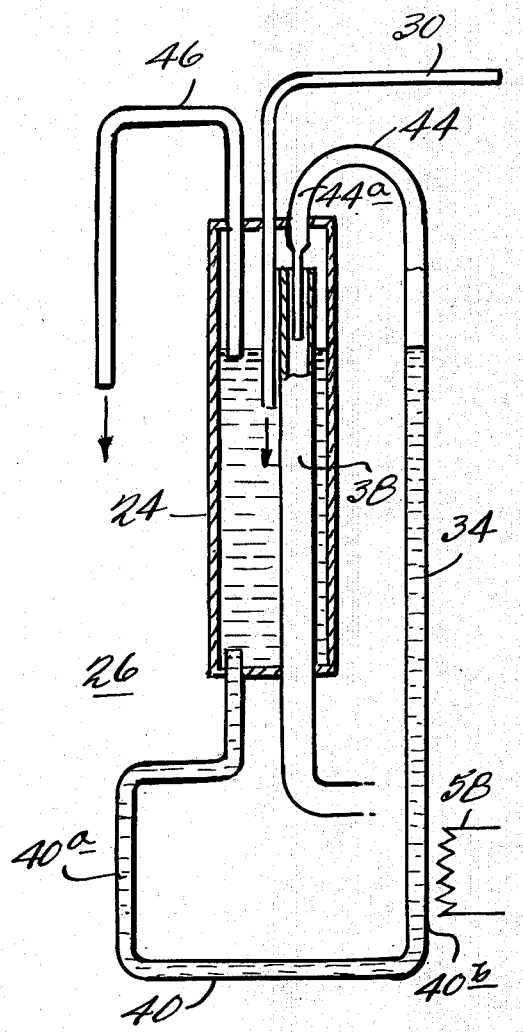
FIG. 7
FIG. 6
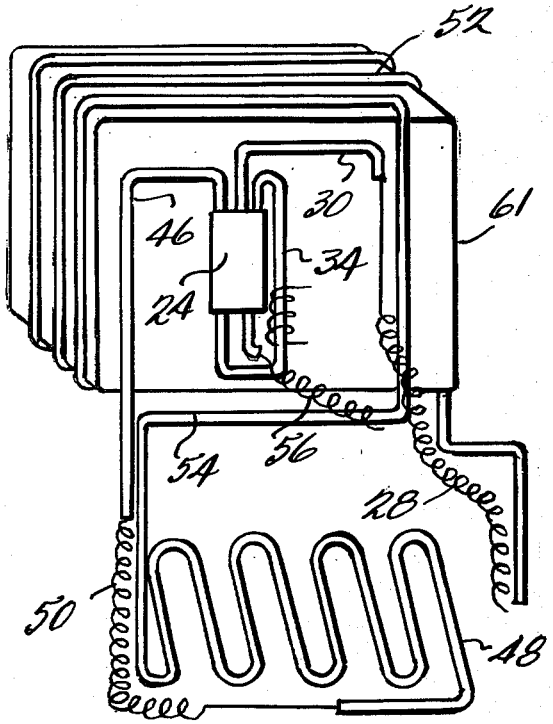

FIG. 10
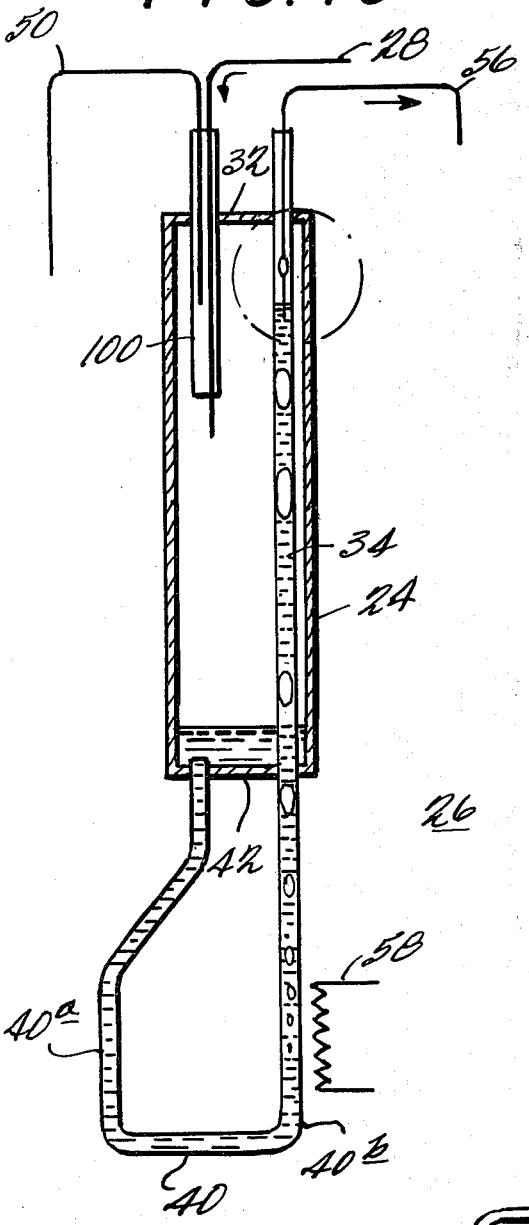
FIG. 11
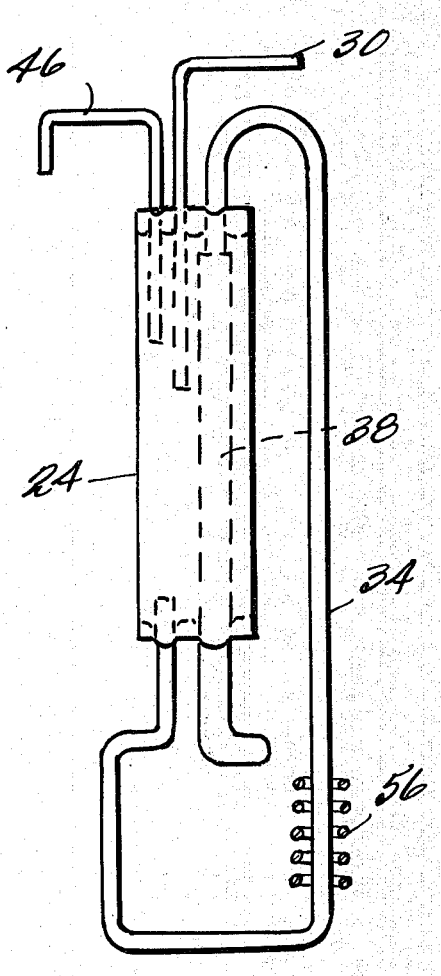
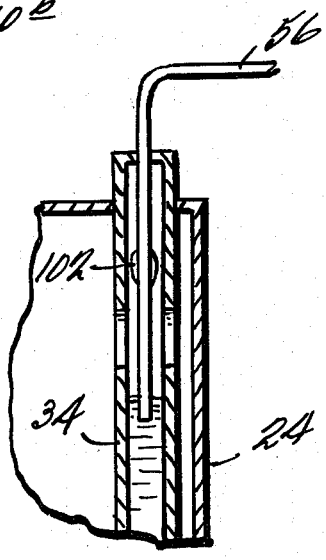
FIG. 12

REFRIGERATING APPARATUS

BACKGROUND OF THE INVENTION

This invention relates to a refrigerating apparatus, and more particularly to an improvement in a refrigerating apparatus in which at least two evaporators are controlled to different temperatures.

Generally, a refrigerator having a freezing compartment and a refrigerating compartment which are controlled to different temperatures has separate evaporators for the freezing compartment and for the refrigerating compartment because separate cooling is necessary for each compartment. Although separate evaporators are provided, it is preferable that a compressor and a condensor are used in common for those separate evaporators. Accordingly, refrigerant feed control to one or both of evaporators is necessary. For example, the refrigerant is always fed to the freezing evaporator while the refrigerant is selectively fed to the refrigerating evaporator by a solenoid valve when the compressor is energized. Separate temperature control is thus attained by control of the solenoid valve in conjunction with control of the compressor.

However, such solenoid valve is usually a mechanically movable one which is buried in a heat-insulating material so that it is difficult to maintain or inspect the valve after the refrigerator is assembled. Accordingly, the life and reliability of the refrigerator are not sufficient, and moreover, this structure is too expensive.

Feed control devices or arrangements which employ a vapor bubble pump providing valve action to refrigerant have been developed. Thus, mechanical movable parts can be eliminated from the feed control devices of the refrigerator. Such arrangements are disclosed, for example, in U.S. Pat. No. 2,697,331.

SUMMARY OF THE INVENTION

Accordingly, one object of this invention is to provide a refrigerating apparatus which has a refrigerant feed control arrangement incorporating a vapor bubble pump of stable and efficient operation.

BRIEF DESCRIPTION OF THE DRAWINGS

Other objects and advantages of this invention will be apparent from the following detailed description of the presently preferred exemplary embodiments taken in conjunction with the accompanying drawings, in which:

FIG. 5 shows a wiring diagram for the apparatus of this invention;

FIG. 6 is a schematic planar view of assembled feed control device of this invention;

FIGS. 7–10 are schematic cross-sectional views of modified feed control device incorporatable in the circuit shown in FIG. 1;

FIG. 11 is a schematic plan view of the feed control device shown in FIG. 7; and FIG. 12 is an enlarged view, partly in section of the feed control device shown in FIG. 10.

DETAILED DESCRIPTION OF THE PREFERRED EMBODIMENTS

Figure 1:
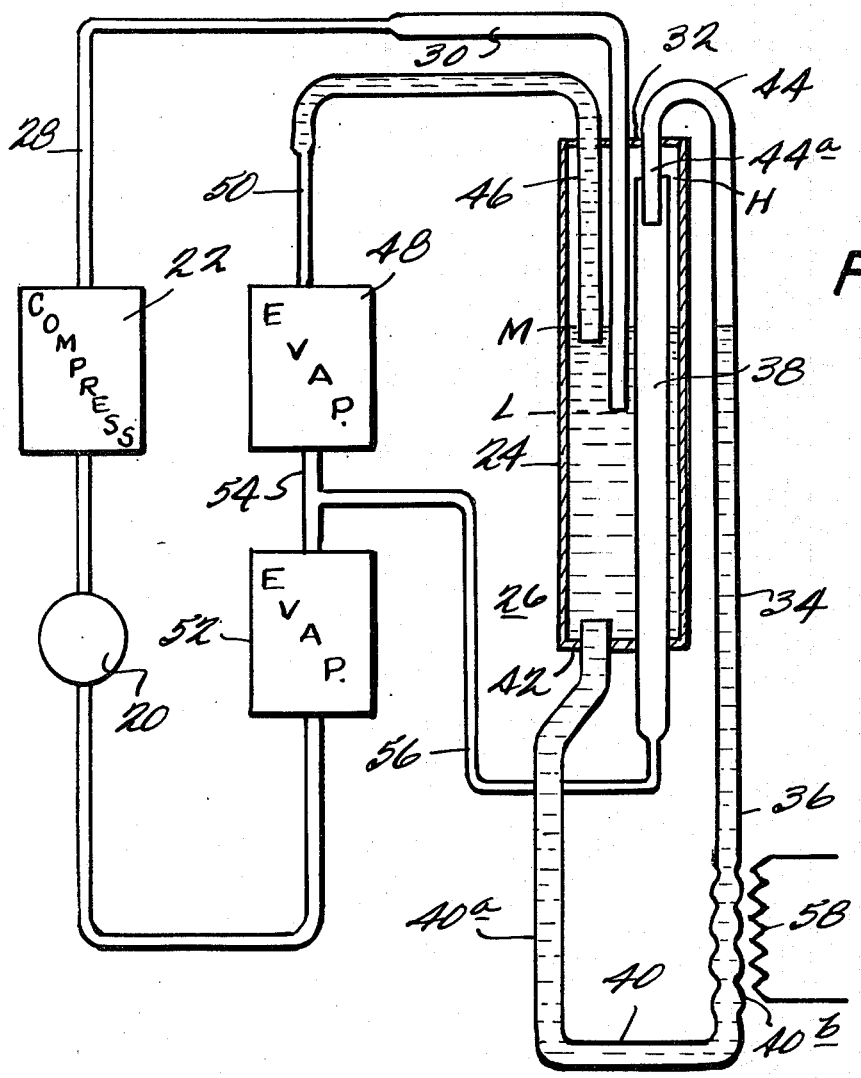
FIG. 1 shows a schematic view of a refrigerant flow circuit of this invention.

Referring to FIG. 1, high temperature gas of a refrigerant which is compressed by a compressor 20 is condensed by a condensor 22 and supplied to a liquid tank 24 of a feed control device 26 through a pressure regulator such as a capillary tube 28 and a conduit 30. One end of conduit 30 is extended through a top wall 32 of tank 24 and located in tank 24 at a predetermined height as indicated by L in FIG. 1.

Feed control device 26 includes a conduit 34 which is formed with a first body 36 and a second body 38. First body 36 is located almost entirely outside of tank 24 while second body 38 is located almost entirely in tank 24.

First body 36 includes a generally U-shaped portion 40 at a lower end thereof. One leg end **40*a* of generally U-shaped portion 40 is extended through the bottom 42 of tank 24 to form a tank outlet. First body 36 also includes an inverted generally U-shaped portion 44 at an upper end thereof. One leg end 44*a* of inverted generally U-shaped portion 44 is extended through top wall 32 and is inserted or connected to second body 38. Body 38 has a diameter larger than that of inverted generally U-shaped portion 44 so that gaseous pressures developed in tank 24 and conduit body 34** are equalized.

One end of conduit 46 which forms an inlet is extended through top wall 32 of tank 24 and is located at a higher position than L as indicated by M in FIG. 1 so as not to draw the refrigerant before storing in tank 24. The other end of conduit 46 is connected to a refrigerator evaporator 48 through a capillary tube 50. Refrigerator evaporator 48 is connected to a freezer evaporator 52 by a connecting conduit 54 to which one end of second body 38 is connected through a capillary tube 56. Freezer evaporator 52 is connected to compressor 20 to form a closed refrigerating cycle.

Figure 4:
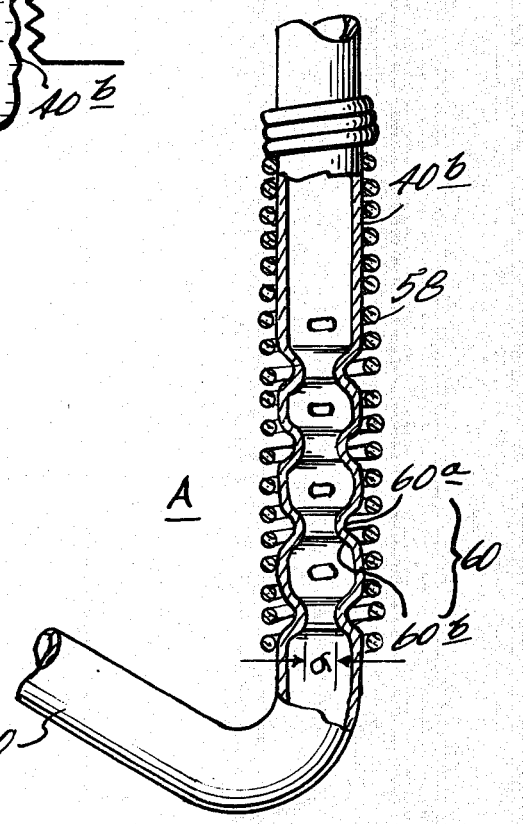
FIG. 4 is an enlarged view, partly in section, of the vapor bubble pump shown in FIGS. 1, 2, and 3.

A heater 58 is provided at the other leg end or rising portion **40*b* of generally U-shaped tube 40. As shown in FIG. 4, tube 40 has irregularly formed portions 60 with alternate concave surfaces 60*a* and convex surfaces 60*b* in the lower end with heater 58 extending there about and about a portion of tube 40 above surfaces 60*a* and 60*b*. First conduit body 36, specifically irregularly formed portions 60 and heater 56 form a vapor bubble pump A. A 5 watt electrical heater would be sufficient for this purpose. Each leg end 40*a* and 40*b* of tube 40 is spaced from each other at a sufficient distance, such as 80 mm, so that heater 56 can be easily wound around leg end 40*b***.

FIG. 5 is a wiring diagram of this embodiment. Generally, compressor 20 operates within a given temperature range of a freezing compartment 61, as shown in FIG. 6, except when defrosting operation is not selected. During the operation of compressor 20, refrigerant is always fed to freezer evaporator 52, but refrigerant flow caused by condensor 22 is selectively fed to refrigerator evaporator 48 depending on the temperature of the refrigerating compartment (not shown) for preventing the same from being over-cooled.

A motor 70 of compressor 20 is driven when the contacts (a-c) of a defrost switch 72 are closed (i.e., defrosting operation is now chosen) upon the closure of a control switch 74, which is closed when the temperature of freezing compartment 60 reaches an upper end of a predetermined operating range. Heater 58 of vapor bubble pump A, a connecting pipe heater 76 and a drain gutter 78 are energized when the temperature of the refrigerating compartment falls below a predetermined value so that a refrigerating control switch 80 is turned on. When freezing compartment 60 exceeds the lower end of its predetermined operating range, motor 70 is stopped and control switch 74 is opened. The defrosting cycle, which is conventional, is attained by closing contacts (b-c) of defrost switch 72 to energize a defrost heater 82 for heating freezer evaporator 52 and a defrost sensor heater for obtaining stable operation of defrost heater 82. The defrost sensor includes a bimetal switch 86 which opens when the defrosting cycle is finished. A door switch 88 is closed when the door of refrigerating compartment is opened and a lamp 90 which is located in the refrigerating compartment is turned on. A drain heater 92 prevents the drain opening of the freezing compartment from freezing, a heater 94 heats control switch 74 for ensuring stable operation thereof, and a fuse 96 is connected in series with heater 58 of vapor bubble pump A.

The operation will now be explained. When the temperature of refrigerating compartment and the freezing compartment are higher than respective predetermined values, control switch 74 is kept closed and refrigerating control switch 80 is kept open. The motor 70 of compressor 20 is driven while heater 58 is kept de-energized. The refrigerant which is compressed by compressor 20 is stored in liquid tank 24. The liquid refrigerant flows into conduit 46 when the liquid level in tank 24 rises higher than the level M, as easily understood from FIG. 2.

The liquid refrigerant goes to refrigerator evaporator 48 through conduit 46 and capillary tube 50, and to freezer evaporator 52 through conduit 54 so that both compartments are cooled. In this condition, it is expected that the liquid refrigerant will not flow into second body 38 of conduit body 34 through generally U-shaped tube 44 because the inner gaseous pressures developed in liquid tank 24, first body 36 and second body 38 are kept equal by loosely connecting leg end 44*a* and second body 38 in tank 24 and liquid levels in tank 24 and first body 36 are kept equal.

Heater 58 is energized when control switch 80 turns on due to the fact that the refrigerator compartment has been cooled to a predetermined temperature. Vapor bubbles of liquid refrigerant are produced by heating leg end or rising portion 40*b* with heater 58. The liquid refrigerant is pumped up by the bubbles and overflows from leg end 44*a* into body 38, as easily understood from FIG. 3. At this time the liquid refrigerant level in tank 24 is reduced because the liquid refrigerant flows into freezing evaporator 52 through capillary tube 56. It is expected that liquid refrigerant will not flow to refrigerator evaporator 48 through conduit 46 and capillary tube 50 because liquid level in tank 24 is lower than the level indicated by M. The inlet of conduit 46 is in higher position than the top level of stored refrigerant in tank 24. The cooling of the refrigerating compartment is, thus, interrupted because of no flow of refrigerant to refrigerator evaporator 48. This condition continues until the temperature of refrigerator compartment reaches the upper end of its predetermined operating temperature range at which time heater 58 is automatically deenergized, restoring the normal flow of liquid refrigerant through the refrigerating compartment to the freezer compartment.

Heater 58 is wound around the outer surface of irregularly formed portions 60 so that the bubbles are produced relatively quickly at irregularly formed portions 60. Bubbles are also produced at non-irregular portions above irregular portions 60; however, they are smoothly produced and the resistance against the flow of liquid refrigerant including the bubbles produced at lower level is small. The bubbles can go up smoothly and pumping action for pushing up the refrigerant begins relatively quickly. The pumping efficiency is, thus, improved. As leg end 40*a* of tube 40 is spaced from heater 58, the liquid refrigerant in leg end 40*a* is prevented from producing bubbles.

Figure 2:
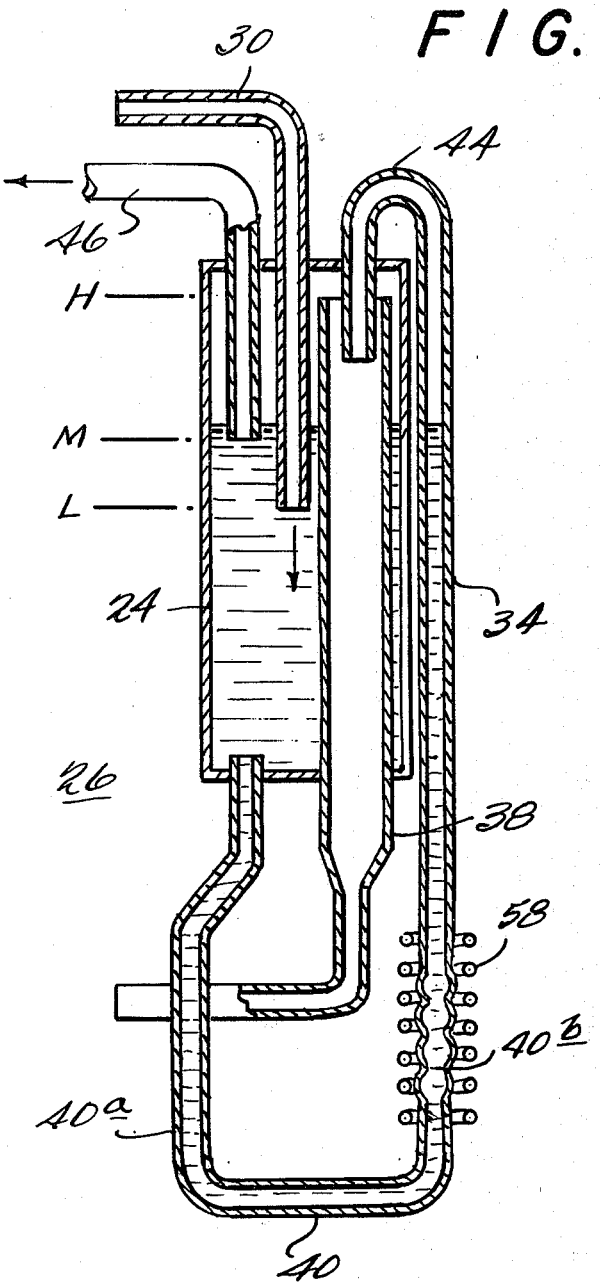
FIG. 2 is a schematic cross-sectional view of the feed control device incorporated in the circuit shown in FIG. 1, showing the bubble pump not in operation.
Figure 3:
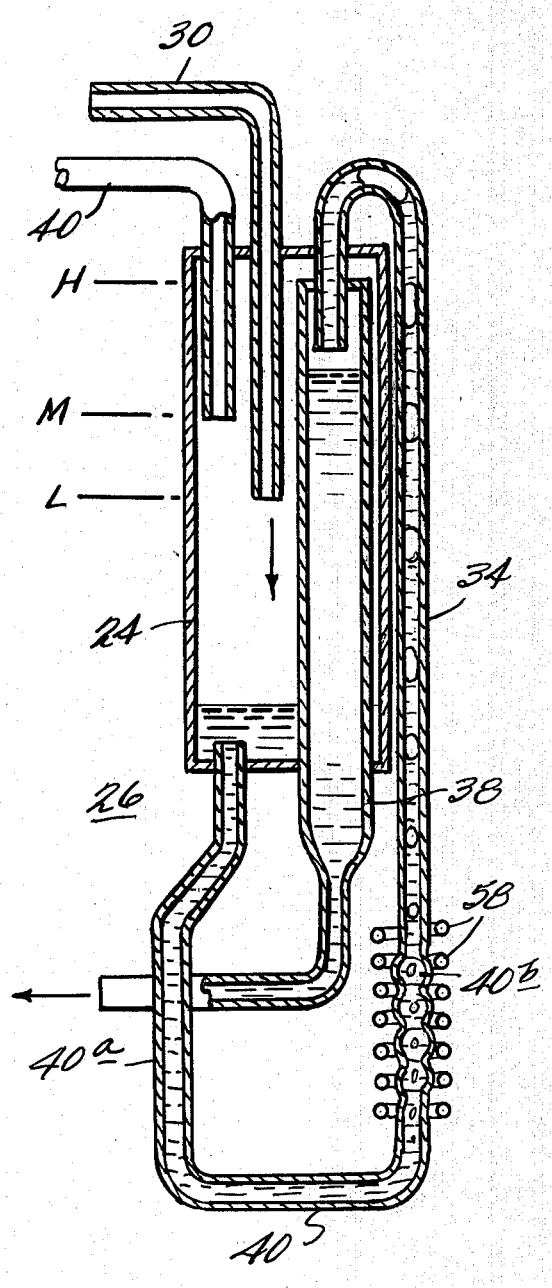
FIG. 3 is a schematic cross-sectional view of the feed control device incorporated in the circuit shown in FIG. 1, showing the vapor pump in operation.

It will be observed that as shown in FIGS. 1 to 3, a part of conduit body 36, specifically second body 38, is disposed in heat exchange relation with refrigerant stored in tank 24. This heat exchange arrangement provides for transfer of heat from warmer overflow refrigerant in second body 38 to colder liquid refrigerant in tank 24. Accordingly, cooled and almost liquified refrigerant is fed to freezer evaporator 52 while the warmed refrigerant is fed to conduit body 34 so that the bubbles can be quickly produced by heater 58. This heat exchange arrangement enhances the efficiency of refrigerating cycle. FIG. 6 shows the assembled feed control device.

To prevent unwanted flow of liquid refrigerant to refrigerator evaporator 48 when vapor bubble pump A is operating and to prevent flowing the liquid refrigerant back to compressor 20 due to excessive supply of liquid refrigerant to freezer evaporator 52 when vapor bubble pump A begins to operate, the volume of tank 24 must properly be determined. The effective volume measured between inlets of conduits 34 and 46 would usually be selected to be 10–50 cc. If the effective volume is less than such preferable values, unwanted flow of liquid refrigerant to refrigerator evaporator 48 is likely to occur when vapor bubble pump A is operating and unwated flow of refrigerant in liquid form back to compressor 20 is likely to happen when vapor bubble pump A starts operation.

Obviously, the effective volumes are closely related to the dimensions of tank 4 and second body 38. Accordingly, design of tank 24 and second body 38 must be made by taking into consideration the outer diameter of second body 38. It also should be borne in mind that if maximizing equalizing gaseous pressure developed in tank 24 and conduit body 34 is expected, a passage or an opening should communicate tank 24 to conduit body 34 with a cross-sectional area more than 10 $mm^2$.

FIG. 7 shows a modified feed controller 26 which has a narrowed outlet on leg end 44*a* of generally inverted U-shaped tube 44. Having a narrowed outlet end on leg end 44*a*, second body 38 having relatively small outer diameter can be used with an adequate equalizing effect. Such narrowed end may be formed by squeezing. However, the narrowed end has a minimum inner diameter for preventing the liquid refrigerant from staying thereat. Experimental results on this embodiment reveal the minimum inner cross-sectional area is about 3 $mm^2$. Instead of narrowed end of leg end 44*a*, an enlarged end provided on the end of second body 38 may also be used.

Figure 8:
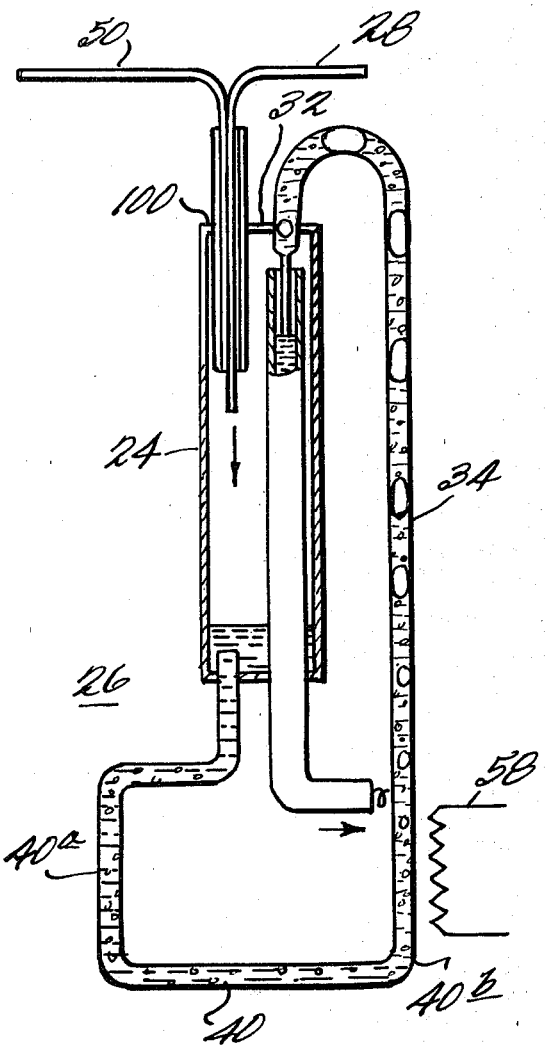

As shown in FIG. 8, the liquid refrigerant may be supplied to tank 24 from condensor 22 and to refrigerator evaporator 48 from tank 24 by using capillary tubes 28 and 50, respectively, instead of conduits 30 and 46. A pipe 100 in which capillary tubes 28 and 50 are bundled is extended through top wall 32 of tank 24. One end of pipe 100 is located in tank 24 while the other end thereof is outside of tank 24 and tightly sealed. Each end of capillary tube 28 and 50 is placed at a predetermined height in tank in the same manner mentioned with respect to conduits 30 and 46 in FIGS. 1 to 3. This embodiment has the advantage of simplifying assembly of feed controller 26 in comparison with embodiment shown in FIGS. 1 to 3. Two attaching steps at top wall 32 are carried out on this embodiment while three attaching steps are carried out on the embodiment shown in FIGS. 1 to 3.

Figure 9:
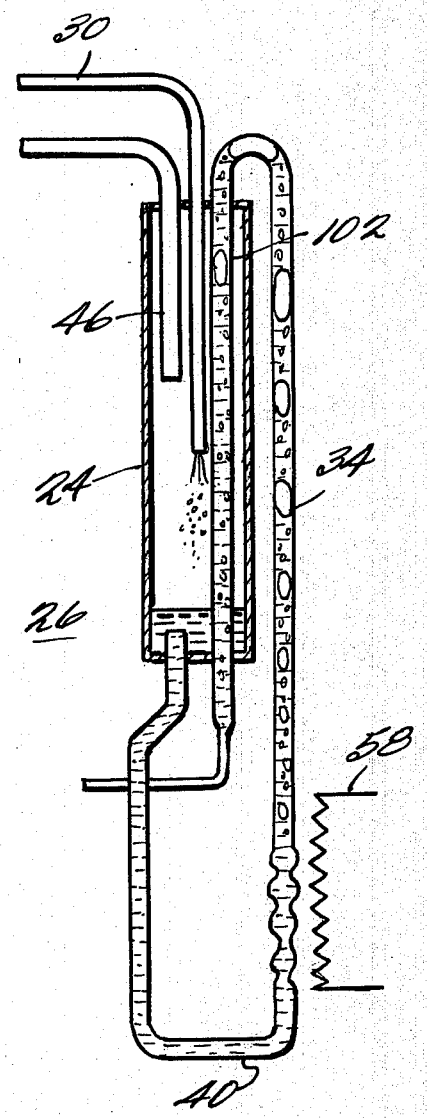

As shown in FIG. 9, conduit body 34 may be formed with one piece conduit. In such instance, at least one opening 102 must be provided at a predetermined height for equalizing gaseous pressure developed in tank 24 and conduit body 34 as like manner carried out on the embodiment shown in FIGS. 1 to 3.

FIG. 10 shows another embodiment of which conduit body 34 which is formed in one piece is extended through both walls 32 and 42 and is almost entirely placed in tank 24 except U-shaped tube 40. The liquid refrigerant flowing up in conduit body is supplied to freezer evaporator 52 through capillary tube 56 without using conduits. As clearly shown in FIG. 11, capillary tube 56 is inserted in conduit body 34 and its end is located lower than an opening 102 provided on conduit body 34.

As mentioned above, this invention provides a conduit for feeding the refrigerant to one of the evaporators when a vapor bubble pump is operating. One part of the conduit extends in the tank in heat exchange relation with the liquid refrigerant therein so that the warmed refrigerant including bubbles is cooled and is almost liquified before being fed to one of the evaporators while the liquid refrigerant stored in the tank is slightly warmed before being fed to the vapor bubble pump. Accordingly, the efficiency of the refrigerating cycle is enhanced.

Further, as a conduit provides a passage or an opening in a liquid tank so as to communicate the tank to the conduit and equalize a gaseous pressure developed in the tank and the conduit, another pipe connecting the tank and the conduit body for equalizing purposes is not required. Accordingly, the feed control arrangement can be small.

The feed control device may be changed to allow refrigerant flow both to refrigerator and freezer evaporators when the vapor bubble pump operates, although according to the above embodiments the refrigerant is fed only to the freezer evaporator when the vapor pump operates. This invention can be applied to freezing apparatus having more than two evaporators controlled to different temperatures.

Many changes and modifications in the above-described embodiments can be carried out without departing from the scope of the present invention. That scope is intended to be limited only by the scope of the appended claims.

What is claimed is:

1. Apparatus for feeding refrigerant in a refrigerator to a first evaporator and a second evaporator connected to receive refrigerant from the first evaporator, comprising:

tank means for storing refrigerant having an inlet for receiving refrigerant, a first outlet for supplying refrigerant to said first evaporator and a second outlet;

conduit means connected to said second outlet for supplying said refrigerant to said second evaporator and extending at least in part in said tank in heat exchange with refrigerant therein, and connected to the interior of said tank means for equalizing gaseous pressures developed in said tank means, said conduit means including a generally U-shaped tube at a lower portion thereof, one end of said tube extending into said tank means to collect said refrigerant; and vapor pump means provided at a portion of said conduit means for causing, when operating, said refrigerant to be supplied to said second evaporator through said conduit means and causing refrigerant to cease to be supplied to said first evaporator.

2. Apparatus as in claim 1, wherein said conduit means further includes an inverted generally U-shaped tube provided at an upper part thereof, one leg end of said inverted generally U-shaped tube being extended into said tank means and a heat exchange tube connected to said one leg end and extending through said tank means, to feed refrigerant to said second evaporator.

3. Apparatus as in claim 1, wherein said one upper leg of inverted generally U-shaped tube is so connected to said heat exchange tube so that the refrigerant fed by said vapor pump means can be fed to said heat exchange tube without leakage.

4. Apparatus as in claim 3, wherein said space is provided between said tubes for equalizing pressure.

5. Apparatus as in claim 1, wherein a portion of said conduit means in said tank is provided with an opening for equalizing pressure.

6. Apparatus as in claim 1, including a pipe means extending into said tank means defining said inlet and first outlet.

7. Apparatus as in claim 6, including a first capillary tube extending through said pipe means for supplying refrigerant to said tank means and a second capillary tube for supplying refrigerant to said first evaporator.

8. Refrigerating apparatus comprising:

a first evaporator for receiving flow of refrigerant therethrough to cool to temperatures within a first range;

a second evaporator connected to said first evaporator for receiving flow of refrigerant from said first evaporator to cool to temperatures within a second range;

a tank for storing said refrigerant and having a first outlet for supplying refrigerant to said first evaporator, a second outlet and an inlet;

a condensor connected to said inlet for supplying said refrigerant to said tank;

conduit means connected to said second outlet for supplying refrigerant to said second evaporator and extending at least in part to said tank in heat exchange relation with refrigerant therein, and connected to the interior of said tank means for equalizing gaseous pressures developed in said tank means, said conduit means including a generally U-shaped tube at a lower portion thereof, one end of said tube extending into said tank means to collect said refrigerant; and vapor pump means provided at a portion of said conduit means for causing, when operating, said refrigerant to be supplied to said second evaporator through said conduit means.

9. Refrigerator apparatus as in claim 8, wherein said conduit means includes an inverted generally U-shaped tube provided at upper part thereof, one leg end of said inverted generally U-shaped tube being extended into said tank to feed refrigerant raised by said vapor bubble pump means.

10. Refrigerator apparatus as in claim 9, wherein said one leg end of inverted generally U-shaped tube is so-connected to said second body that the refrigerant fed by said vapor bubble pump means can be fed to said second evaporator without leakage.

11. Refrigerator apparatus as in claim 8, 9 or 10, wherein vapor bubble pump means is provided at the other leg end portion of said generally U-shaped tube.

* * * * *

UNITED STATES PATENT AND TRADEMARK OFFICE

CERTIFICATE OF CORRECTION

PATENT NO. : 4,340,404

DATED : July 20, 1982

INVENTOR(S) : Oonishi et al

It is certified that error appears in the above—identified patent and that said Letters Patent is hereby corrected as shown below:

FIGURE 1, delete "COMPRESS" and insert --CONDENSOR-- before "22".

Signed and Sealed this

Second Day of November 1982

[SEAL]

*Attest:*

GERALD J. MOSSINGHOFF

*Attesting Officer*

*Commissioner of Patents and Trademarks*